US005447301A

United States Patent [19]

Renner

[11] Patent Number: 5,447,301

[45] Date of Patent: Sep. 5, 1995

[54] GOVERNOR FOOT ASSEMBLY FOR CYCLICALLY SENSING THE HEIGHT OF A FEEDER SHEET PILE

[75] Inventor: Jochen Renner, Heidelberg, Germany

[73] Assignee: Heidelberger Druckmaschinen Ag, Heidelberg, Germany

[21] Appl. No.: 227,595

[22] Filed: Apr. 14, 1994

[30] Foreign Application Priority Data

Apr. 14, 1993 [DE] Germany ..... 43 12 227.2

[51] Int. Cl.[6] ..... B65H 1/18

[52] U.S. Cl. ..... 271/152; 271/31

[58] Field of Search ..... 271/31, 98, 105, 265, 271/152, 153, 154, 155

[56] References Cited

U.S. PATENT DOCUMENTS

| | | | |
|---|---|---|---|
| 1,545,492 | 7/1925 | Henderson | 271/98 |
| 2,071,115 | 2/1937 | Fleischer . | |
| 2,476,577 | 7/1949 | Backhouse | 271/98 |
| 2,838,306 | 6/1958 | Williams | 271/31 |
| 3,716,226 | 2/1973 | Kistner | 271/154 |
| 4,253,654 | 3/1981 | Buys | 271/155 |

FOREIGN PATENT DOCUMENTS

| | | | |
|---|---|---|---|
| 932727 | 8/1955 | Germany . | |
| 2840624 | 4/1979 | Germany . | |
| 2225674 | 7/1980 | Germany | 271/31 |
| 0153484 | 12/1979 | Japan | 271/155 |
| 0062130 | 4/1982 | Japan | 271/98 |
| 2038291 | 7/1980 | United Kingdom | 271/31 |
| 2096577 | 10/1982 | United Kingdom | 271/98 |
| 776978 | 11/1980 | U.S.S.R. | 271/154 |

*Primary Examiner*—H. Grant Skaggs

*Attorney, Agent, or Firm*—Herbert L. Lerner; Laurence A. Greenberg

[57] ABSTRACT

Governor foot assembly for cyclically sensing the height of a feeder sheet pile of a sheet-fed printing press includes a governor foot mounted above the sheet pile so as to be variable in height and so as to be swingable out of the vicinity of the sheet pile and back into the vicinity thereof, a drive system for cyclically swinging the governor foot, after the height of the sheet pile has been sensed, out of a region above the sheet pile and, before the height of the sheet pile is sensed, again into the region above the sheet pile, and for cyclically lifting the governor foot after measuring the height of the sheet pile and again for lowering the governor foot before measuring the height of the sheet pile, respectively, a spring device having an adjustable spring tension, the spring device connecting the governor foot to the drive system, and a device provided on the governor foot for adjusting the spring tension of the spring device.

17 Claims, 6 Drawing Sheets

5
4
III
6
III
II
9
7
8
3
10
12
16
13
15
61
50
11
17
51
49
18
24
14
22
23
19
2
20
21
1
44
II

GOVERNOR FOOT ASSEMBLY FOR CYCLICALLY SENSING THE HEIGHT OF A FEEDER SHEET PILE

SPECIFICATION

The invention relates to a governor or sensing foot assembly for cyclically sensing or scanning the height of a feeder sheet pile of a sheet-fed printing machine, the governor foot assembly including a governor foot mounted above the sheet pile so as to be variable in height and so as to be swingable out of the vicinity of the sheet pile and back into the vicinity thereof, controlled drive means for cyclically swinging the governor foot, after the height of the sheet pile has been sensed, out of a region above the sheet pile and, before the height of the sheet pile is sensed, again into the region above the sheet pile, and drive means for cyclically lifting the governor foot after measuring the height of the sheet pile and again for lowering the governor foot before measuring the height of the sheet pile, respectively.

It has become known heretofore to measure the height of feeder sheet piles by means of a governor foot and to adjust the pile for optimal sheet conveyance to a desired height in accordance with demands for sheet removal by separating and conveying means, such as separator and pull suckers, for example, disposed downline therefrom. For this purpose, conventionally, the governor foot for measuring is lowered onto the pile between the removals of the individual sheets by the separating and conveying means. After the measuring, it is lifted again for releasing the next sheet. In order to permit a more rapid and more reliable sheet removal by the separating and conveying means, it has become known heretofore additionally to swing the governor foot out of the region above the pile, after measuring, and to swing it into the pile region again for the next measurement, after the sheet removal, and to lower it. The force exerted by the governor foot on the pile should be so great as to permit a reliable measurement. With conventional mechanical drives, by which the governor foot is pressed downwardly onto the pile by means of the mechanism, the paper sheets are loaded by the entire mass of the drive system and the sensor or governor so that they can be greatly pressed through. The ripple or corrugation formed therein cause a tripping or stumbling of the sheet, for example, when it is conveyed over leading-edge stops. When blowing under the lifted sheet for better separation, a uniform air flow is hardly possible, so that the sheet undesirably float and flutter and can tear loose from the suckers. It can furthermore be damaged. No assurance can be offered for a reliable height measurement due to the undefined ripple or corrugation. Danger of the foregoing occurrences are especially great at high conveyor/-speeds. On the other hand, the drive system should again release the sheet for the conveyance thereof rapidly and reliably after the height measurement by the governor foot also at high conveyance speeds.

From published German Patent Document DE 32 34 910 C2, such a governor or sensing foot for cyclically sensing the pile height of a feeder sheet pile of a sheet-fed printing press has become known heretofore, wherein a governor foot is fastened to a piston rod of a pneumatic piston which is displaceably mounted in a pneumatic cylinder. The governor foot is lowered by means of the pneumatic system for sensing the height of the sheet pile. After the pile height has been sensed or measured, the governor foot is lifted, due to the restoring force of a compression spring in the cylinder, after the cylinder has been vented. For a simpler more rapid removal of the upper sheet, the pneumatic cylinder is swung about a swivel axis out of the region above the sheet pile by means of a cam drive. For a new measurement of the pile height, the governor foot is again swung into the region and is lowered by means of the pneumatic system.

In the case of such a governor foot device or assembly, in order to ensure that the governor foot acts only with such small bearing forces on the uppermost sheets of the feeder sheet pile so that it does not have any undesired effect upon the sheet pile, a costly control device for the pneumatic system is required. The bearing force, respectively, must be so adjusted that return swings of the governor foot which has been lowered onto the feeder sheet pile are prevented, so that a reliable height measurement is still possible. Especially with the relatively low pneumatic pressure conventionally used in such pneumatic cylinders, a very costly exact control system is required for producing a defined bearing pressure.

Moreover, due to the comparatively high inertial mass or dead weight of a conventionally used pneumatic piston, the danger of sheet damage is especially increased at high press speeds. Pressure applied too intensely through the sheets renders more difficult any exact determination of the height of the pile due to the inexact sensing or scanning which occurs.

It has become known heretofore from U.S. Pat. No. 2,615,713 to lift a sheet holding foot by means of a hook and to let it fall onto the pile from a specific height by releasing the hook. The sheet holding foot is assisted by a compression spring in its falling movement. The sheet holding foot is supposed to exert a force which is as high as possible on the paper sheets of the pile in order to prevent a shifting of the paper sheets during the removal of a lifted sheet. The compression spring may be dispensed with if the sheet holding foot itself applies sufficient pressure. With a sheet holding foot thus accelerated downwardly with a force which is as great as possible to encounter and press against the feeder sheet pile, the great danger exists of the undesired intense application of pressure through the sheets and the damage to the sheets, especially at high speeds. The type of acceleration downwardly, moreover, is too imprecise at high speeds.

From German Published Non-Prosecuted Patent Application (DE-OS) 32 18 565, a vertically-displaceable, spring-supported governor foot has become known heretofore, which also cannot meet the requirements of a rapid sheet conveyance, because the governor foot is located for a long time over the feeder sheet pile. Before the governor foot is lowered, the preceding sheet must be lifted completely and transported away at least so far that it has left the vertical lowering region of the governor foot. Protection against entrainment of the next sheet is not possible through the governor foot. Blowing air under the sheet is possible only with reservations, in that the flow does not have any effect upon the next sheet. The cycle for sensing and accordingly for reducing and removing the pile is undesirably lengthy.

It is accordingly an object of the invention to provide a governor foot assembly for cyclically sensing the height of a feeder sheet pile of a sheet-fed printing press of the foregoing general type which permits, at slight expense, a reliable sensing of the height of the sheet pile even at high speeds, without damaging the surface of the sheet pile.

With the foregoing and other objects in view, there is provided, in accordance with the invention, a governor foot assembly for cyclically sensing the height of a feeder sheet pile of a sheet-fed printing press, the governor foot assembly comprising a governor foot mounted above the sheet pile so as to be variable in height and so as to be swingable out of the vicinity of the sheet pile and back into the vicinity thereof, controlled drive means for cyclically swinging the governor foot, after the height of the sheet pile has been sensed, out of a region above the sheet pile and, before the height of the sheet pile is sensed, again into the region above the sheet pile, and drive means for cyclically lifting the governor foot after measuring the height of the sheet pile and again for lowering the governor foot before measuring the height of the sheet pile, respectively, spring means having an adjustable spring tension, the spring means connecting the governor foot to the drive means for cyclically lifting and lowering the governor foot, and means provided on the governor foot for adjusting the spring tension of the spring means.

Due to spring means transmitting the driving movement of the drive means to the governor foot, a more reliable course of movement of the governor foot for measuring the height for lifting, swinging-out, swinging-in and lowering the governor foot is attained. Due to the force-storing device or spring means transmitting the driving force from the drive means to the governor foot, for one thing, the exact cyclic course of movement is assured even at high press speeds and, for another thing, excessive force above the desired spring force exerted upon the governor foot by the feeder pile when the governor foot is seated thereon is stored, thereby assuring the maintenance of an adjustable permissible force action between the governor foot and the upper sheet of the feeder pile. The spring means permit the governor foot to be seated securely and reliably without any danger of return swings and without damage thereby to the surface of the sheet pile. This is achieved at slight expense or effort without any additional control devices. The decoupling location directly at the governor foot permits a marked reduction in mass, due to which the forces acting upon the sheet pile are greatly reduced, and reliable height measuring and reliable depiling are possible even at high speeds.

In accordance with another feature of the invention, the governor foot assembly includes a governor foot support whereon the governor foot is movably mounted, the governor foot support being in driving connection with the drive means for lifting and lowering and the drive means for swinging the governor foot, the spring means forming the driving connection between the governor foot and the governor foot support. This arrangement is especially simple. The location of the force-storage device or spring means directly on the governor foot permits a minimization of the inertial masses acting upon the surface of the pile, due to which any danger of damage to the sheet is additionally reduced.

In accordance with a further feature of the invention, the governor foot is slidably mounted on the governor foot support. This permits a construction which is especially simple affording a relatively simply definable seating direction of the governor foot onto the feeder pile.

In accordance with an additional feature of the invention, the governor foot is swivellably mounted on the governor foot support.

In accordance with an added feature of the invention, the governor foot assembly includes two parallel couples of like length articulatingly connected at one end thereof, respectively, to the governor foot and at the other end thereof, respectively, to the governor foot support.

In accordance with yet another feature of the invention, the governor foot comprises a cylindrical sleeve, and the governor foot support comprises a bolt whereon the cylindrical sleeve is slidably mounted. This construction is especially simple and economical. With few and very simple means, reliable operability is assured. The inertial masses of the governor foot acting upon the sheet pile surface are able to be reduced thereby. The sleeve can be of especially simple and economical construction for minimizing the masses by selecting a relatively inexpensive, very light plastic material.

In accordance with yet a further feature of the invention, the spring means comprise a restoring spring braced at one end thereof against a bearing location fixed to the press, and at the other end thereof against the governor foot. The preferred restoring spring permits, by relatively simple means, a seating of the governor foot with optimized holding force which is largely unchanged after the seating and, when the governor foot is lifted, an increase in the guidance force acting between the governor foot and the drive, so that a reliable entrainment of the governor foot free of return swinging during the entire lifting and an even more reliable sensing and depiling are assured even at high speeds.

In accordance with yet an added feature of the invention, the spring means comprise a restoring spring braced at one end thereof against the governor foot and at the other end thereof against the governor foot support.

In accordance with another feature of the invention, the governor foot is formed with a sensing surface, and including sensor means for sensing the height of the sensing surface of the governor foot with respect to the feeder sheet pile.

This permits a relatively simple transmission and determination of the sheet pile height sensed by the governor foot.

In accordance with another aspect of the invention, there is provided a governor foot assembly for cyclically sensing the height of a feeder sheet pile of a sheet-fed printing press, the governor foot assembly comprising a governor foot mounted above the sheet pile so as to be variable in height and so as to be swingable out of the vicinity of the sheet pile and back into the vicinity thereof, drive means for cyclically swinging the governor foot, after the height of the sheet pile has been sensed, out of a region above the sheet pile and, before the height of the sheet pile is sensed, again into the region above the sheet pile, and for cyclically lifting the governor foot after measuring the height of the sheet pile and again for lowering the governor foot before measuring the height of the sheet pile, respectively, spring means having an adjustable spring tension, the spring means connecting the governor foot to the drive means, and means provided on the governor foot for adjusting the spring tension of the spring means. This construction permits a swinging, lifting and lowering of the governor foot in common with minimized drive means with reduced inertial masses to be displaced and simple control expense or effort.

In accordance with a further feature of the invention, the drive means comprise a first lever swivellably mounted at one end thereof at a pivot point fixed to a frame of the printing press, a second swivel lever having one end to which the governor foot is fastened and another end by which it is swivellably mounted on the first lever, an entrainer cam drivingly connected to the printing-press drive, the entrainer cam being rotatably mounted at a fixed location of the press and being in continuous entraining contact with a cam follower roller rotatably mounted on the first lever, the second lever having an articulating point located between the ends thereof, and a third lever swivellably mounted at one end thereof at the articulating point on the second lever and at the other end thereof in a bearing fixed to the frame of the printing press. This provides an especially simple, functionally reliable driving connection.

In accordance with an added feature of the invention, the governor foot assembly includes a restoring spring disposed between and operatively engaging the bearing fixed to the frame of the printing press and the governor foot.

In accordance with an additional feature of the invention, the governor foot is constructed as a blast governor foot. This additionally permits under-blowing of the sheets which thus happen to be transported away by down-line conveyor means and, accordingly, an increase in the operability of the sheet pile removal.

In accordance with yet another feature of the invention, the sensing means comprise a non-contacting sensor fixed to a frame of the printing press. This permits an advantageous simple determination of the pile height without any reaction upon the governor foot and the feeder pile.

In accordance with a concomitant feature of the invention, the governor foot assembly includes cam means for cam-guiding the governor foot.

Other features which are considered as characteristic for the invention are set forth in the appended claims.

Although the invention is illustrated and described herein as embodied in a governor foot assembly for cyclically sensing the height of a feeder sheet pile, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
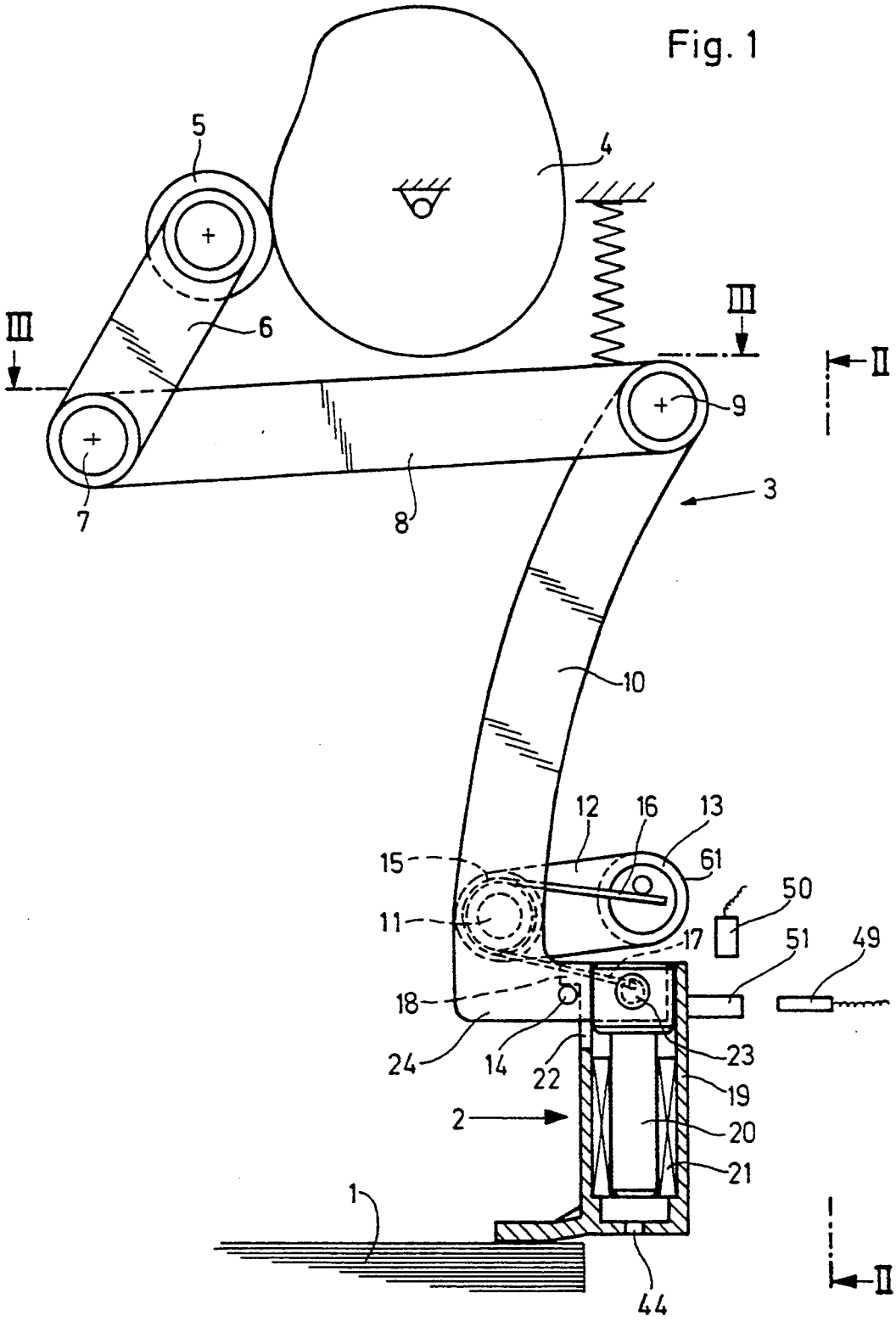
FIG. 1 is a side elevational view of a governor foot assembly.
Figure 4B:
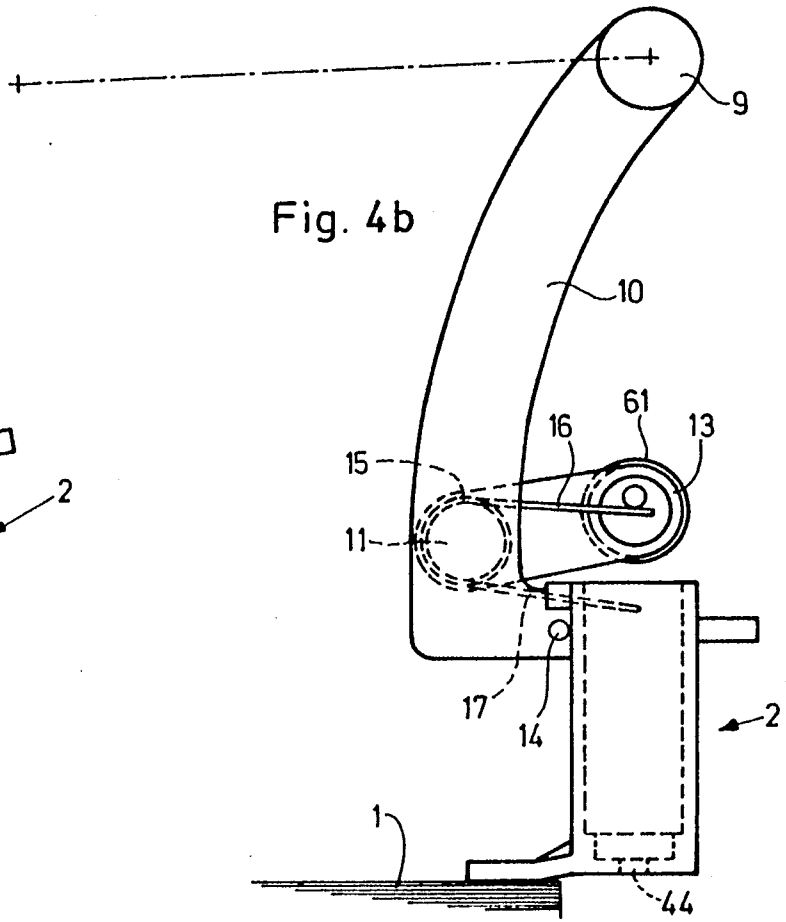
Figure 4A:
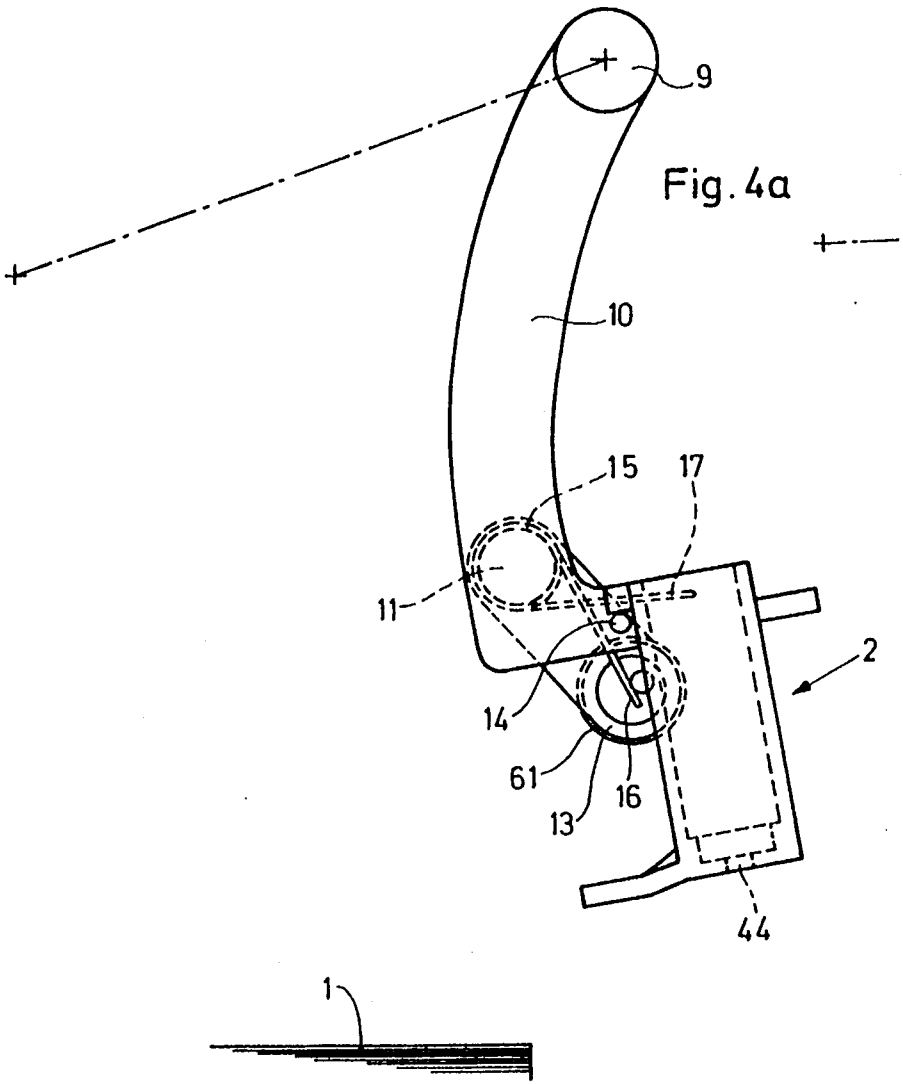
Figure 5:
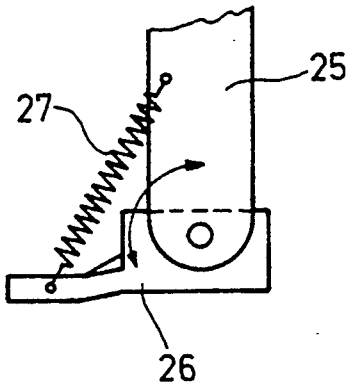
Figure 6:
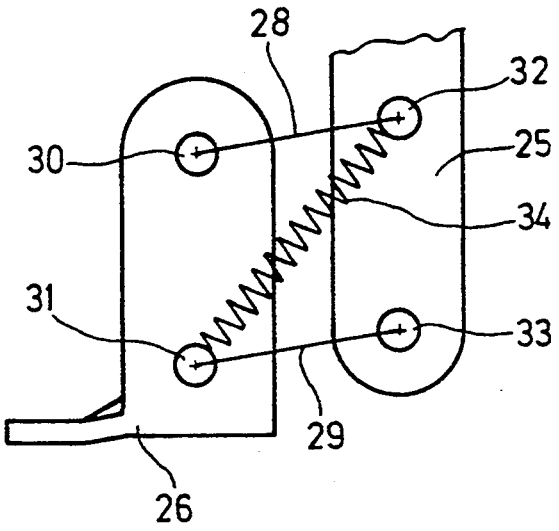
Figure 7:
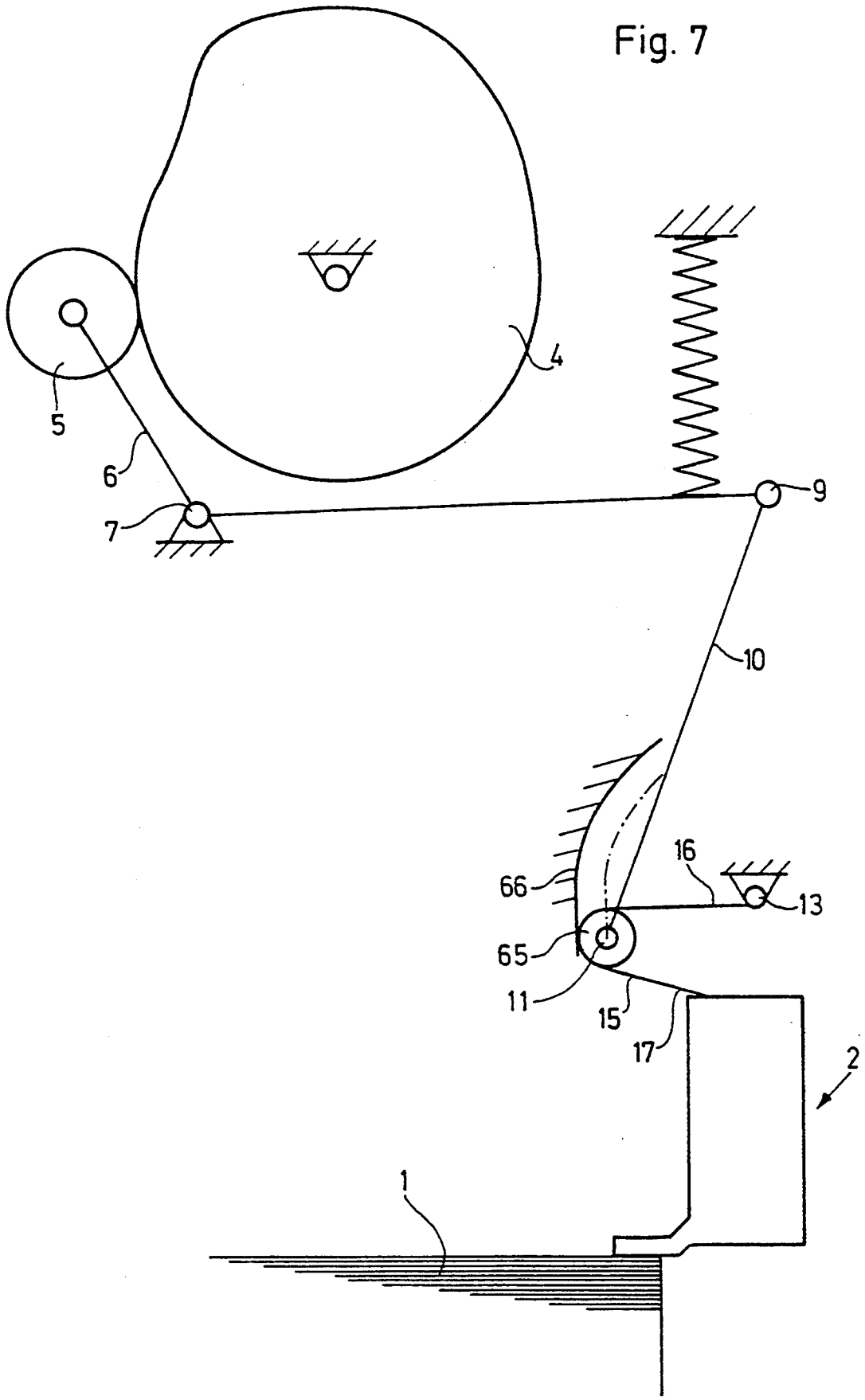
Figure 8:
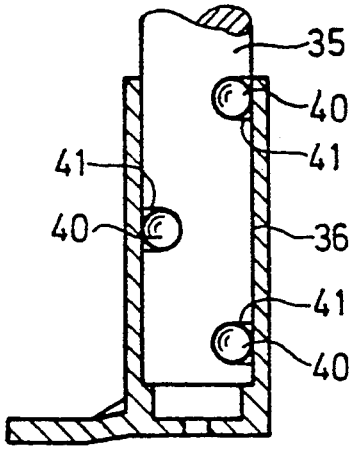
Figure 9:
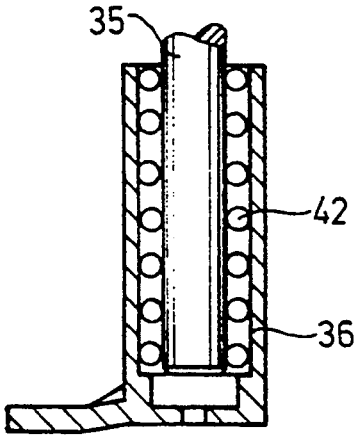
Figure 10:
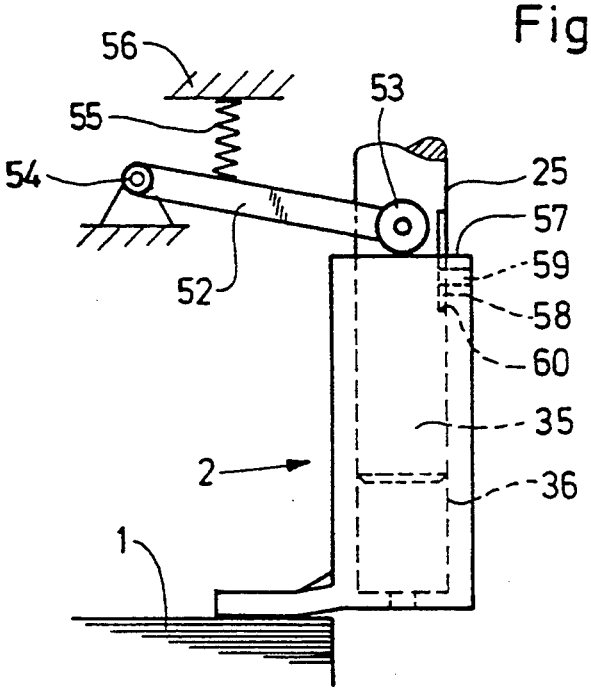

FIGS. 4*a* and 4*b* are fragmentary views of FIG. 1 showing the governor foot thereof in different phases of operation thereof, namely, in outwardly swung lifted position and in inwardly swung lowered measuring position, respectively;

FIGS. 5 and 6 are diagrammatic fragmentary views of FIG. 1 showing a second and a third embodiment, respectively, of the governor foot;

FIG. 7 is a diagrammatic view of FIG. 1 showing another embodiment of the drive system for the governor foot;

FIGS. 8 and 9 are diagrammatic fragmentary views of FIG. 1 showing the governor foot with different embodiments of the support therefor; and FIG. 10 is a diagrammatic fragmentary view of FIG. 1 sowing a third embodiment of the governor foot.

Figure 2:
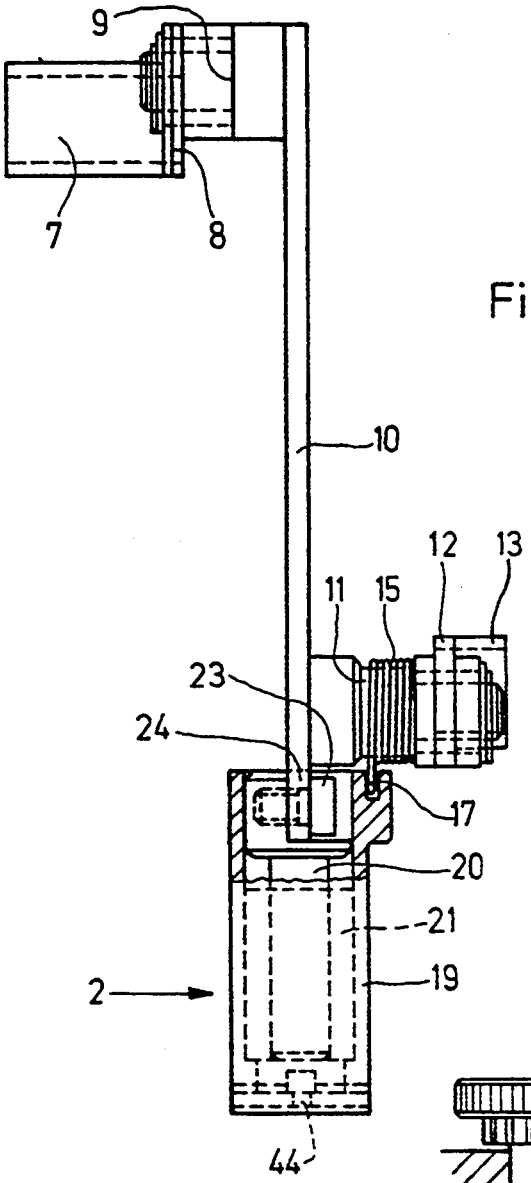
FIG. 2 is a view of FIG. 1 taken along the line II—II in the direction of the arrows.
Figure 3:
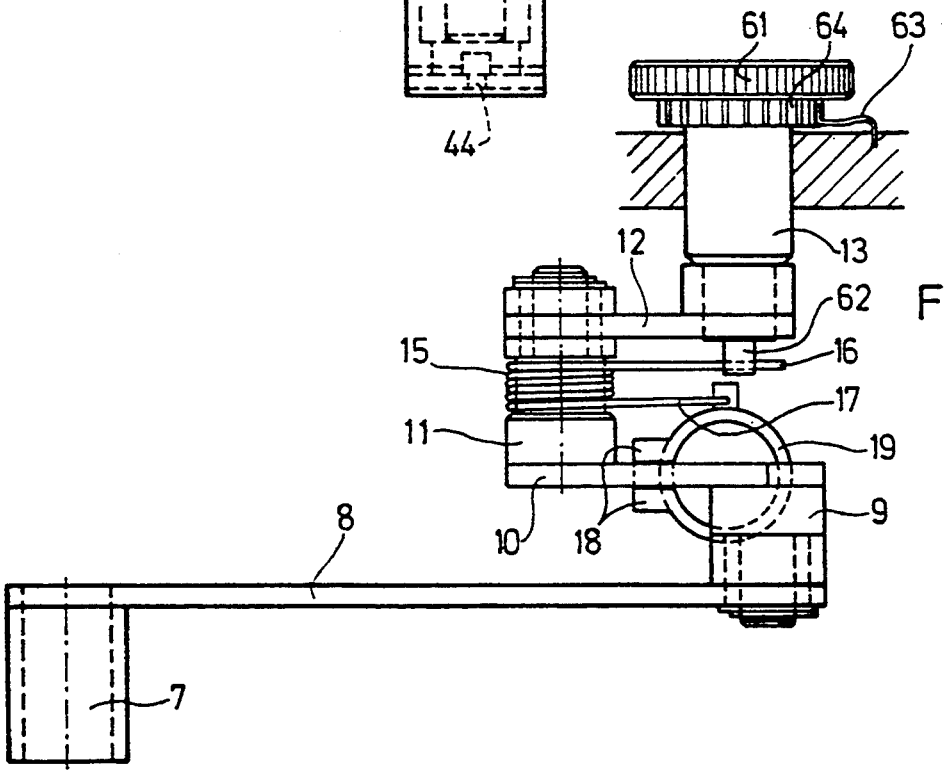
FIG. 3 is a cross-sectional view of FIG. 1 taken along the line III—III in the direction of the arrows.

Referring now to the drawings and, first, particularly to FIGS. 1 to 3 thereof, there is shown therein, in a governor foot assembly of a sheet-fed rotary printing press, a governor foot 2 which, in a conventional manner, is cyclically reciprocatingly displaced, above leading edges of the sheets of a sheet pile 1, in a sheet conveying direction, i.e., from the righthand side to the lefthand side in FIG. 1. The governor foot 2 is formed with a governor foot body 19 of light plastic material or aluminum, for example, by which it is displaceably mounted through the intermediary of a slide bearing 21 on a cylinder bolt 20. The cylinder bolt 20 is fastened by a screw 23 to a governor foot support region 24 of a lever 10. The governor foot support region 24, in this regard, extends through or into the cylindrical governor foot body 19 through a recess 22 which is formed therein. The lever 10 has an end opposite from the governor foot support region 24, and is linked at that end by a pivot pin 9 to a lever arm 8 of a double-armed lever 6. The lever 6 is mounted so as to swivel about a pivot shaft 7 which is fixed to the press. An entrainer or follower roller 5 is rotatably mounted on the lever 6 and is in continuous entraining contact with a drive cam 4 rotatably mounted on the press frame and driven by the press drive system in a conventional manner, the drive cam 4 being shown diagrammatically and reduced in size relative to the other illustrated components. The lever 10 is swivellably linked to a lever 12 via a swivel shaft 11 between the articulating point or pivot pin 9 and the governor foot support region 24. The lever 12, in turn, is swivellably mounted in a bearing 13 fixed to the press. A spiral spring is wound around the swivel shaft 11 and has ends 16 and 17 which are braced, respectively, against the bearing or pivot shaft 13 and the governor foot body 19.

To detect the pile height, the governor foot 2 is lowered in cyclical coordination with the separating and pull sucker displacement for the sheet acceptance and conveyance by means of the drive cam 4, the cam follower roller 5, and the levers 6 and 10 due to the swivelling thereof about the fixed pivot points 7 and 13, as well as by means of the spiral spring 15, and is swung into a position above the trailing edge of the sheet pile. Due to the spring tension of the spring 15, the governor foot 2 is thus continuously pressed downwardly. Due to the engagement by a projection 18 of the governor foot 2 with a limit pin 14 fastened to the governor foot support region 24 of the lever 10, the governor foot 2 is protected from falling out downwardly. After the governor foot 2 has been seated upon the upper sheet of the sheet pile 1 in the vicinity of the leading edge thereof, the governor foot 2 is held in position on the cylinder bolt or bearing pin 20 by virtue of the force exerted by the pile 1 upon the governor foot 2 against the spring tension of the spring 15, and thus lifted relatively to the further lowered governor foot support region 24 of the lever 10. The governor foot 2, independently of the speed thereof, accordingly presses against the sheet pile 1 only with its own slight inertial forces thereof as well as with the spring tension of the spring 15. By means of a sensor 49 or 50, for example, which determines the respective distance at which the respective sensor 49 and 50 is spaced from a measurement projection 51 on the governor foot 2, can the respective height of the feeder pile 1 be determined precisely every time the governor foot 2 is seated upon the pile 1 and, by connecting the sensors in a conventional manner with suitable conventional means for controlling the drive means for adjusting the height of the feeder pile 1, can the feeder pile 1 be adjusted to the desired height. The pretensioned spring 15 permits the governor foot 2 to be seated reliably and free of oscillations on the feeder pile 1.

After the measurement operation has ended, the drive cam 4 is turned further so that the entrainer pin 14 is again lifted out of the lowered position thereof with respect to the projection 18, which exists during the measuring operation as shown in FIG. 4*b*, so that it comes into contact engagement with the projection 18 and entrains the governor foot 2 through the intermediary of the projection 18. The governor foot 2 is thus again lifted above the cam drive and swung out of the region above the feeder sheet pile 1, as illustrated in FIG. 4*a*.

The spring 15 shown in FIGS. 1, 4*a* and 4*b*, of which the spring arm 16 is braced against a fixed articulating arm 13, permits the reliable oscillation-free entrainment due to increased spring tension during the lifting operation and gentle seating of the governor foot 2 on feeder sheet pile 1 when the spring tension is reduced. It is also conceivable to brace the spring arm 16 against a spring bearing fastened to the lever 10 and accordingly displaced therewith. Of course, with such a spring, after the governor foot 2 has been seated on the sheet pile 1, the spring tension will relatively greatly increase further.

The spring tension is adjustable by means of a swivel shaft 13, for example, in the form of a knurled-head pin or bolt 61, as shown in FIGS. 1 and 3. The spring arm 16 lies against a pin 62 fastened eccentrically to the swivel shaft 13. A stop spring 63 (FIG. 3) engages in toothing 64, by which the spring 16 is safeguarded against shifting.

Further embodiments of the governor foot according to the invention are diagrammatically illustrated in FIGS. 5 and 6. In the embodiment of FIG. 5, the governor foot 26 is swivellably linked to a governor foot support 25. The governor foot support 25 and the governor foot 26 are connected to a compression spring 27, which downwardly swivels the governor foot 26, as viewed in FIG. 5. The governor foot 26 is seated, by the region thereof located at the left-hand side of the swivel point in FIG. 5, onto the delivery pile for measuring. The governor foot 26, when being seated, is swung slightly upwardly, relatively to the further lowered governor foot support 25, about the swivel point and against the force of the spring 27. After the measuring operation, the governor foot 26 is lifted together with the governor foot support 25 by the latter via a non-illustrated entrainer on the governor foot support 25 which downwardly limits the swivel path. In the embodiment illustrated in FIG. 6, the governor foot 26 is shown linked at two articulating locations 30 and 31 via two couples 28 and 29, respectively, to two articulating locations 32 and 33, respectively, of the governor foot support 25. In this parallelogram-shaped four-bar linkage, diametrically opposite articulating locations 31 and 32 are connected to one another by a compression spring 34. In this embodiment also, the governor foot 26 is moved towards the feeder pile by the drive system and the governor foot support 25, as well as the spring 34. After the governor foot 26 has been seated on the feeder pile, the governor foot 26 is lifted against the action of the spring 34 relatively to the further lowered governor foot support 25. After the measuring operation is terminated, the governor foot 26 is again lifted by the governor foot support 25 and the couples 28 and 29, together therewith.

It is also conceivable, as shown in FIGS. 8 to 10, to form the governor foot support as a cylinder bolt 35 which is displaceably mounted in a cylindrical bore 36 formed in the governor foot 26.

For throttling the bottom of the governor foot 2, it is furthermore conceivable to form a throttling bore 44 in the governor foot 2, as shown, for example, in FIG. 1.

The governor foot 2 according to the embodiments of FIGS. 1 and 7 can be mounted on the governor foot support 25, for example, by slide bearings, however, also by any other conceivable displacing or shifting bearings. Thus, as shown in FIG. 8, ball bearings 40 can be provided in transversely extending guide grooves 41 formed in bearing bolts or, as shown in FIG. 9, conventional bearings with balls 42 may be provided.

In FIG. 10, yet another conceivable embodiment of the governor foot 2 is represented. The governor foot 2 is guided, in a manner protected against torsion or twisting, by means of a guide pin 59 which engages in a guide groove 58 extending parallel to the axis of governor foot support 25, and can be lifted or lowered relatively to the governor foot support 25. Protection against movement of the guide pin 59 is provided by a stop 60 in the guide groove 58 of the governor foot support 25, thereby preventing the governor foot 2 from falling down. A follower roller 53, which is swivellably mounted on a lever 52, presses against the governor foot 2.

The lever 52 is mounted so as to be swivellable about a swivel pin 54 fastened to the governor foot support 25. The lever 52 is pressed downwardly in a direction towards the feeder pile 1 by a compression spring 55, which is braced against a spring bearing 56. The spring bearing 56 can be formed fixed to the press for producing a progressive characteristic curve or fixed to the drive for producing a linear characteristic curve.

It is also conceivable to form the governor foot 2 in a conventional manner as a blast or blowing governor foot.

It is likewise conceivable to form the governor foot drive, as shown in FIG. 7, so that the lever 6 is mounted with a lever arm articulatingly in the swivel axis 9 on the lever 10, and the governor foot 2 is articulatingly connected to the lever 10 at the swivel axis 11, a roller 65 being rotatably mounted concentrically with the swivel axis 11. The roller 65 is in continuous contact engagement with a cam 66 fixed to the press. The governor foot 2 is pretensioned downwardly by the spring 15. The drive of the governor foot 2 is effected via the cam 4 and the levers 6 and 10. Guidance by the cam 4 permits optimal seating of the governor foot 2 in a direction substantially perpendicularly to the surface of the sheet pile 1.

I claim:

1. Governor foot assembly for cyclically sensing the height of a feeder sheet pile of a sheet-fed printing press, the governor foot assembly comprising a governor foot mounted above the sheet pile so as to be variable in height and so as to be swingable out of the vicinity of the sheet pile and back into the vicinity thereof, drive means for cyclically swinging said governor foot, after the height of the sheet pile has been sensed, out of a region above the sheet pile and, before the height of the sheet pile is sensed, again into the region above the sheet pile, and for cyclically lifting said governor foot after measuring the height of the sheet pile and again for lowering said governor foot before measuring the height of the sheet pile, respectively, spring means having an adjustable spring tension, said spring means connecting said governor foot to said drive means.

2. Governor foot assembly according to claim 1, wherein said drive means comprise a first lever swivellably mounted at one end thereof at a pivot point fixed to a frame of the printing press, a second swivel lever having one end to which said governor foot is fastened and another end by which it is swivellably mounted on said first lever, an entrainer cam drivingly connected to the printing-press drive, said entrainer cam being rotatably mounted at a fixed location of the press and being in continuous entraining contact with a cam follower roller rotatably mounted on said first lever, said second lever having an articulating point located between said ends thereof, and a third lever swivellably mounted at one end thereof at said articulating point on said second lever and at the other end thereof in a bearing fixed to the frame of the printing press.

3. Governor foot assembly according to claim 2, wherein said spring means include a restoring spring disposed between and operatively engaging said bearing fixed to the frame of the printing press and said governor foot.

4. The governor foot assembly according to claim 1, including means operatively associated with said governor foot for adjusting the spring tension of said spring means.

5. The governor foot assembly according to claim 1, including means provided on said drive means and operatively associated with said governor foot for adjusting the spring tension of said spring means.

6. Governor foot assembly for cyclically sensing the height of a feeder sheet pile of a sheet-fed printing press, the governor foot assembly comprising a governor foot mounted above the sheet pile so as to be variable in height and so as to be swingable out of the vicinity of the sheet pile and back into the vicinity thereof, controlled drive means for cyclically swinging said governor foot, after the height of the sheet pile has been sensed, out of a region above the sheet pile and, before the height of the sheet pile is sensed, again into the region above the sheet pile, and drive means for cyclically lifting said governor foot after measuring the height of the sheet pile and again for lowering said governor foot before measuring the height of the sheet pile, respectively, spring means having an adjustable spring tension, said spring means connecting said governor foot to said drive means for cyclically lifting and lowering said governor foot.

7. Governor foot assembly according to claim 6, including a governor foot support whereon said governor foot is movably mounted, said governor foot support being in driving connection with said drive means for lifting and lowering and said drive means for swinging said governor foot, said spring means forming said drive connection between said governor foot and said governor foot support.

8. Governor foot assembly according to claim 7, wherein said governor foot is slidably mounted on said governor foot support.

9. Governor foot assembly according to claim 8, wherein said governor foot comprises a cylindrical sleeve, and said governor foot support comprises a bolt whereon said cylindrical sleeve is slidably mounted.

10. Governor foot assembly according to claim 7, wherein said spring means comprise a restoring spring braced at one end thereof against said governor foot and at the other end thereof against said governor foot support.

11. Governor foot assembly according to claim 6, wherein said spring means comprise a restoring spring braced at one end thereof against a bearing location fixed to the press, and at the other end thereof against said governor foot.

12. Governor foot assembly according to claim 6, wherein said governor foot is formed with a sensing surface, and including sensor means for sensing the height of said sensing surface of said governor foot with respect to the feeder sheet pile.

13. Governor foot assembly according to claim 12, wherein said sensing means comprise a non-contacting sensor fixed to a frame of the printing press.

14. Governor foot assembly according to claim 6, wherein said governor foot is constructed as a blast governor foot.

15. Governor foot assembly according to claim 6, including cam means for cam-guiding said governor foot.

16. The governor foot assembly according to claim 6, including means operatively associated with said governor foot for adjusting the spring tension of said spring means.

17. The governor foot assembly according to claim 6, including means provided on said drive means and operatively associated with said governor foot for adjusting the spring tension of said spring means.

* * * * *